US008905563B2

(12) United States Patent
Wu et al.

(10) Patent No.: US 8,905,563 B2
(45) Date of Patent: Dec. 9, 2014

(54) DISPLAY DEVICE WITH NARROWED FRAME BORDER AND MANUFACTURING METHOD THEREOF

(71) Applicant: AU Optronics Corporation, Hsin-Chu (TW)

(72) Inventors: Chia-Hao Wu, Hsin-Chu (TW); Darman Ng, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 100 days.

(21) Appl. No.: 13/739,093

(22) Filed: Jan. 11, 2013

(65) Prior Publication Data

US 2013/0265739 A1 Oct. 10, 2013

(30) Foreign Application Priority Data

Apr. 10, 2012 (TW) ..... 101112631 A

(51) Int. Cl.
*F21V 8/00* (2006.01)
*G09F 13/04* (2006.01)
*F21V 9/14* (2006.01)

(52) U.S. Cl.
CPC .. *G09F 13/04* (2013.01); *F21V 9/14* (2013.01)
USPC ..... 362/19; 362/621; 362/608; 362/97.1; 362/97.4

(58) Field of Classification Search
USPC ..... 362/19, 97.1, 97.4, 621, 608
See application file for complete search history.

(56) References Cited

U.S. PATENT DOCUMENTS 7,585,098 B2 * 9/2009 Mikami ..... 362/608
8,614,775 B2 * 12/2013 Zhou ..... 349/64
8,622,600 B2 * 1/2014 Cheng et al. ..... 362/608
2013/0033891 A1 * 2/2013 Cheng et al. ..... 362/602
2014/0063844 A1 * 3/2014 Que et al. ..... 362/609

FOREIGN PATENT DOCUMENTS

CN 101957506 A 1/2011
CN 102175002 A 9/2011
TW I256499 6/2006
TW I317837 12/2009
TW M399339 3/2011

OTHER PUBLICATIONS

English translation of abstract of TW M399339 (Mar. 1, 2011).
English translation of abstract of TW I256499 (Jun. 11, 2006).
English translation of abstract of TW I317837 (Dec. 1, 2009).
English translation of abstract of CN 102175002 A (Sep. 7, 2011).
English translation of abstract of CN 101957506 A (Jan. 26, 2011).
China Office Action dated Dec. 23, 2013.

* cited by examiner

*Primary Examiner* — Anabel Ton
(74) *Attorney, Agent, or Firm* — McClure, Qualey & Rodack, LLP

(57) ABSTRACT

A display device with narrowed frame border and a manufacturing method thereof are provided. The display device includes a backlight module, an optical film, and a display panel. The backlight module includes an outer frame and a light source module. The outer frame has a bottom plate and a sidewall connected to the bottom plate, and the light source module is disposed in the outer frame near the sidewall. The optical film is disposed on the backlight module and covers the light source module. One side of the optical film protrudes outside from the sidewall and is bent to attach a portion of the sidewall. The display panel is disposed on the optical film opposite to the backlight module.

14 Claims, 6 Drawing Sheets

DISPLAY DEVICE WITH NARROWED FRAME BORDER AND MANUFACTURING METHOD THEREOF

BACKGROUND OF THE INVENTION

1. Field of the Invention

The present invention relates to a display device; particularly, the present invention relates to a display device with a narrower frame border width.

2. Description of the Prior Art

In applications of display device, especially for the handheld display device, getting a narrower sized frame border for the display device is a main subject of product improvement to promote the quality of appearance and minimize the volume of modules. The method of minimizing the size of the display device usually minimizes or eliminates component units at the periphery according to requirements. However, the current approaches still have some problems described as follows.

FIG. 1 is a schematic view of the traditional display device. As shown in FIG. 1, the periphery of the traditional display device 10 mainly includes a frame 20 and a back plate 30, and the back plate 30 covers the frame 20 to protect the traditional display device 10. The traditional display device 10 has a frame border width L1, i.e. the length from one end of the panel sealing material 41 to the outer edge of the back plate 30. As shown in FIG. 1, the periphery of the display device 10 includes a certain thickness of frame 20 and back plate 30, resulting in overly wide frame border width L1 and increased overall volume. The overly wide frame border width L1 will cause a poor appearance. There are two well-known approaches to minimize the size of the traditional display device 10; one is to remove a part of the frame 20 so as to shorten the distance between the panel sealing material 41 and the back plate 30; the other one is to remove the entire back plate 30 as well as a part of the frame 20 to effectively shorten the frame border width L1. Although the second approach can make the border length of each module in the frame 20 to be equal to the border length of the display device 10, without the protection of the back plate 30, the structural strength will be greatly decreased, and the traditional display device 10 is likely to be damaged. Moreover, the size reduction effect provided by the first approach mentioned above is still not perfect.

SUMMARY OF THE INVENTION

It is an object of the present invention to provide a display device having a narrower frame border width.

It is another object of the present invention to provide a display device having a frame border width equal to that of the display panel so as to achieve a smaller volume while maintaining the original structural strength.

It is another object of the present invention to provide a manufacturing method of the display device to produce a display device with a narrowed frame.

The display device includes a backlight module, an optical film, and a display panel. The backlight module includes an outer frame and a light source module. The outer frame has a bottom plate and a sidewall connected to one side of the bottom plate. The light source module is disposed in the outer frame and located on an inner side of the sidewall. The optical film is disposed above the backlight module and covers the light source module. The edge of the optical film protrudes outside the sidewall and is bent to partially overlap the sidewall. The display panel is disposed on the surface of the optical film opposite to the backlight module. After the optical film and the outer frame are combined, the stability of the integral structure will be increased by the structural strength provided by the optical film, and the size of the display device can be narrowed while the backlight module is protected by the outer frame.

The manufacturing method of the display device mentioned above includes the following steps: disposing the light source module in the outer frame to form the backlight module; attaching the display panel onto the optical film opposite to the backlight module; disposing the optical film on the backlight module, so that at least one side of the optical film protrudes outside the sidewall, and bending the protruding part of the optical film along the top end of the sidewall to overlap the surface of the sidewall.

DETAILED DESCRIPTION OF THE PREFERRED EMBODIMENT

Figure 1:
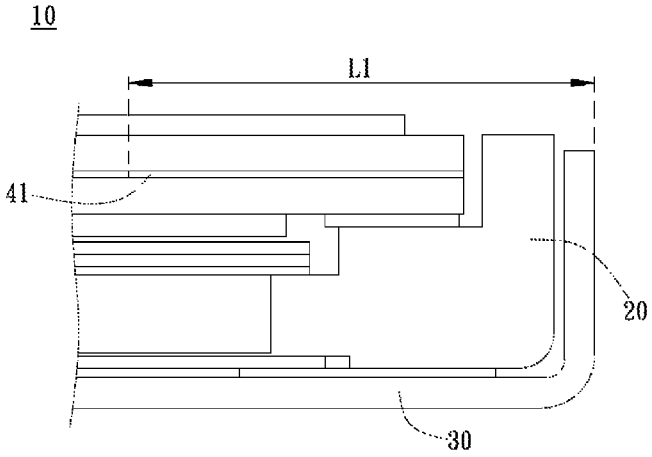
FIG. 1(PRIOR ART)
FIG. 1 is a schematic view of the traditional display device.
Figure 2A:
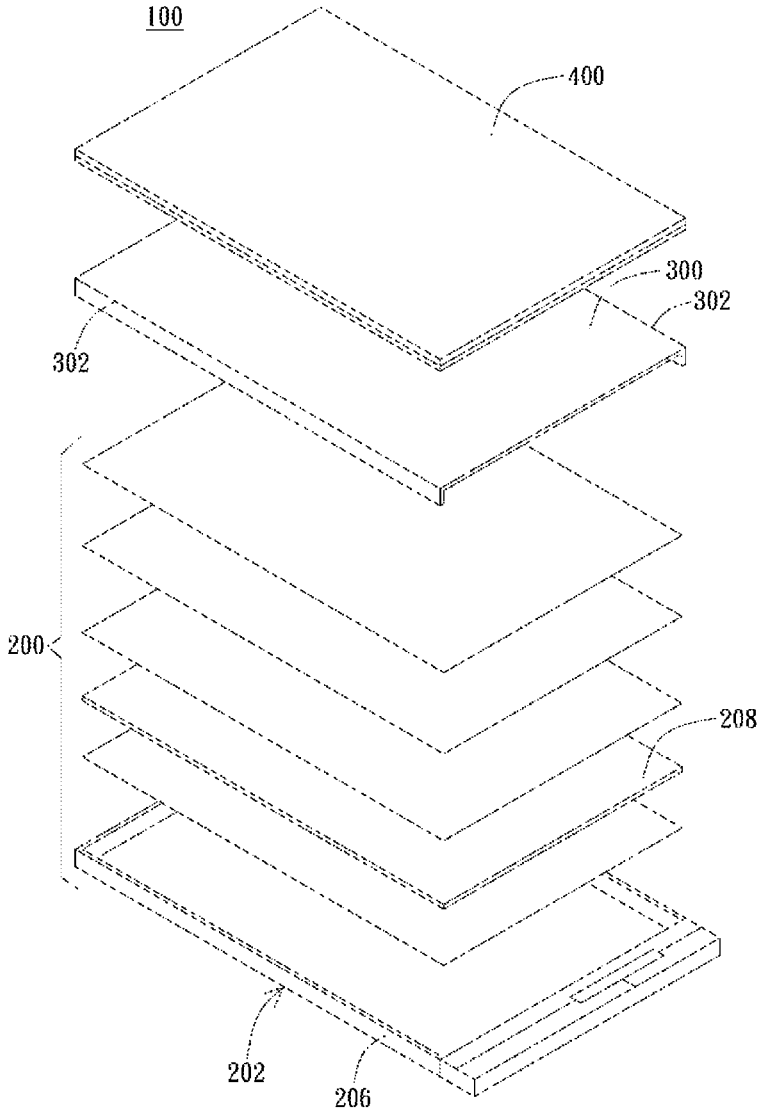
FIG. 2A and FIG. 2B are schematic views of the display device of the present invention.
Figure 2B:
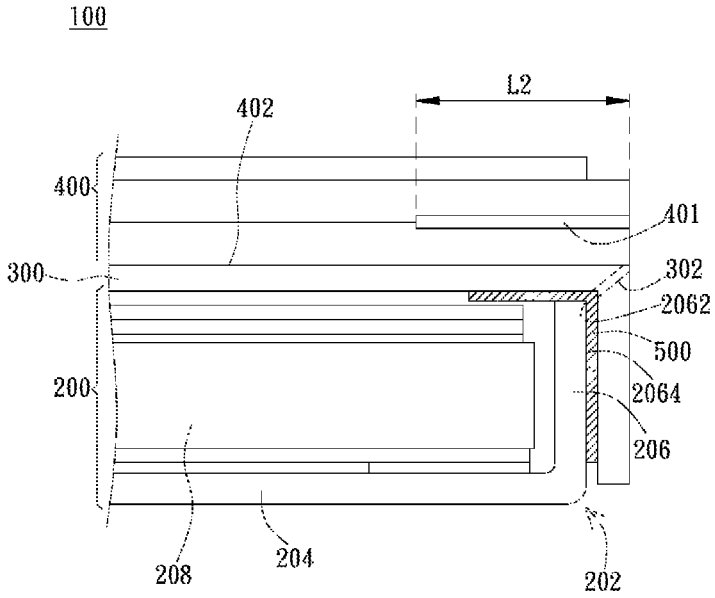

FIG. 2A and FIG. 2B are schematic views of the display device of the present invention. The display device 100 of the present invention includes a backlight module 200, an optical film 300, and a display panel 400. The backlight module 200 includes an outer frame 202 and a light source module 208. The outer frame 202 is preferably made of metal materials or may be made of polymer composite materials. The outer frame 202 has a bottom plate 204 and a sidewall 206 connected to one side of the bottom plate 204. The bottom plate 204 may be a solid plate or a partially hollow-carved plate based on design requirements. The sidewall 206 is disposed on least one side of the bottom plate 204 and preferably on two corresponding sides of the bottom plate 204. The light source module 208 is disposed in the outer frame 202 and located on an inner side of the sidewall 206. In a preferred embodiment, the light source module 208 is an edge type light source module including a light guide plate; in other embodiments, the light source module 208 may be adopted a direct type light source module.

The optical film 300 is disposed above the backlight module 200 and covers the light source module 208, wherein the surface of the optical film 300 opposite to the backlight module 200 is attached to a light incident surface 402 of the display panel 400. In this embodiment, the optical film 300 is preferred a polarization film and is directly attached to the light incident surface 402 of the display panel 400 by adhesives. When the optical film 300 is directly adhered to the light incident surface 402 of the display panel 400, the structural strength of the optical film 300, the outer frame 202, and the backlight module 200 will be increased by the stiffness of the display panel 400. The optical film 300 can be a diffusion film, a brightness enhancement film, a filter film, or other films which can provide different optical effects. The optical film 300 may be separably, in direct or indirect manner, attached to the light incident surface 402. As shown in FIG. 2B, one side of the optical film 300 protrudes outside the sidewall 206 and is bent to partially overlap the sidewall 206. The display panel 400 is disposed on the surface of the optical film 300 opposite to the backlight module 200. In this embodiment, the bottom surface of the optical film 300 is supported by the top end 2062 of the sidewall 206. The bending part of the optical film 300 is attached to the outer surface of the sidewall 206. After the optical film 300 and the outer frame 202 are combined, the stability of the integral structure will be increased by the surface tension and the structural strength provided by the optical film 300.

Please refer to FIG. 2A and FIG. 2B, a folding line 302 is formed on the optical film 300 corresponding to the top end 2062 of the sidewall 206. The position of the folding line 302 corresponds to the top end 2062 of the sidewall 206 and the outer edge of the display panel. The material strength at the folding line 302 is weaker than that of the optical film 300 at other positions. For example, the folding line 302 is in a form of indentation or spaced slits, so that the folding line 302 is apt to be bent compared to other positions of the optical film 300. Therefore, the rebound force results from the bending of the optical film 300 will be decreased to ensure good attachment force between the sidewall 206 and the bending part of the optical film 300. Formation of the folding line 302 depends on the size of the optical film 300 and the bending convenience to the optical film 300, so that the material strength at the folding line 302 is weaker than that of the optical film 300 at other positions.

The optical film 300 and the sidewall 206 are connected by a double-sided adhesive tape 500. Particularly, the double-sided adhesive tape is bent into two parts; one part is located between the non-bending part of the optical film 300 and the top end 2062 of the sidewall 206; the other part is located between the bending part of the optical film 300 and the side surface 2064 of the sidewall 206 where the optical film 300 overlaps. In addition, in a preferred embodiment, the double-sided adhesive tape has light shielding property to avoid light leakage from the side of the display device 100.

As shown in FIG. 2B, the display device 100 has a frame border width L2, i.e. the width from a panel sealing material 401 to the outer edge of the optical film 300, or the width from the panel sealing material 401 to the outer edge of the display panel 400. The side edge of the display panel 400 extends over the top end 2062 of the sidewall 206 and is indirectly supported by the top end 2062 through the optical film 300. Because the backlight module 200 is combined with the optical film 300 and the outer frame 202 of the backlight module 200 is disposed under the optical film 300, the sidewall 206 functions to enhance the structure and to support the display panel 400. As such, the frame border width L2 of the display device L2 and the frame border width of the display panel can be equal. In this way, the backlight module 200 can be protected by the outer frame 202 and the size of the display device 100 can be reduced. Besides, the stability of the structure can be enhanced by the overlap relationship of the optical film 300 and the sidewall 206. However, in other embodiments, a plastic frame can be disposed, based on requirements, between the outer frame 202 and the light source module 208 for assembling and supporting component units which do not require the narrowed frame.

Figure 3:
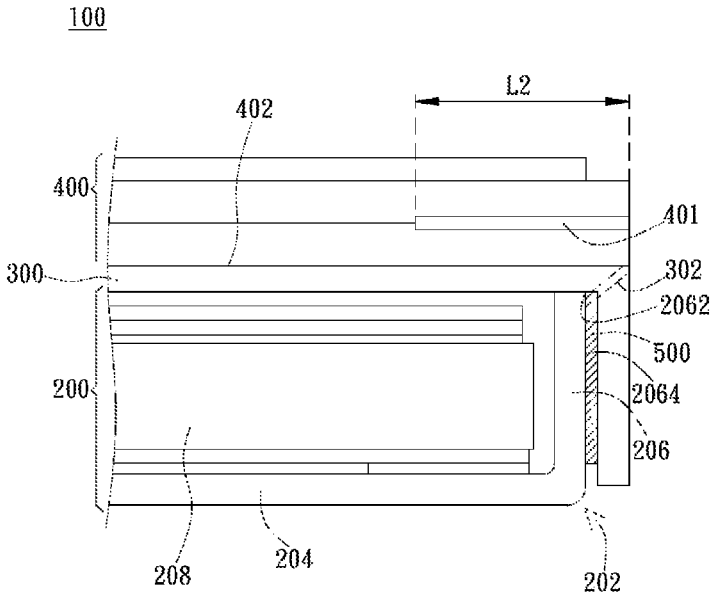
FIG. 3 is a schematic view of another embodiment of the display device.

FIG. 3 is a schematic view of another embodiment of the display device. As shown in FIG. 3, in another embodiment, the double-sided adhesive tape 500 is disposed only between the bending part of the optical film 300 and the side surface 2064 of the sidewall 206 that the optical film 300 overlaps. When the double-sided adhesive tape 500 is disposed only between the bending part of the optical film 300 and the side surface 2064 of the sidewall 206 that the optical film 300 overlaps, as shown in FIG. 3, the connection stability may be enhanced; besides, the double-sided adhesive tape 500 may be pressed simultaneously while bending the optical film 300 to enhance the adhesive force by pressing. In addition, the bending configuration of optical film 300 can be applied to two longer sides of the display device 100 or to only one longer side. The bending configuration of optical film 300 can also be applied to the shorter sides to further minimize the size of the display device 100.

Figure 4:
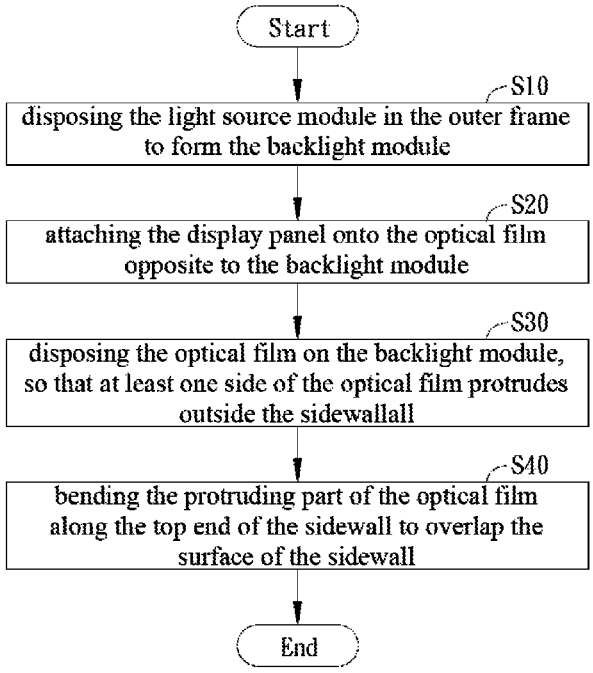
FIG. 4 is a flow chart of assembling the display device of the present invention.

FIG. 4 is a flow chart of assembling the display device mentioned above of the present invention. The manufacturing method of the display device includes the following steps: step S10 of disposing the light source module in the outer frame to form the backlight module, step S20 of attaching the display panel onto the optical film opposite to the backlight module, step S30 of disposing the optical film on the backlight module, so that at least one side of the optical film protrudes outside the sidewall, and step S40 of bending the protruding part of the optical film along the top end of the sidewall to overlap the surface of the sidewall. The folding line at the bending part of the optical film corresponds the top end of the sidewall of the outer frame. The optical film is bent to at least partially overlap the surface of the sidewall, wherein a double-sided adhesive tape disposed is disposed between the bending part of the optical film and the surface of the sidewall for connecting the optical film and the sidewall. The edge of the assembled display panel is aligned to the folding line of the optical film and supported by the top end the sidewall of the outer frame, so that the frame border width of the display device and the frame border width of the display panel are equal.

Figure 5:
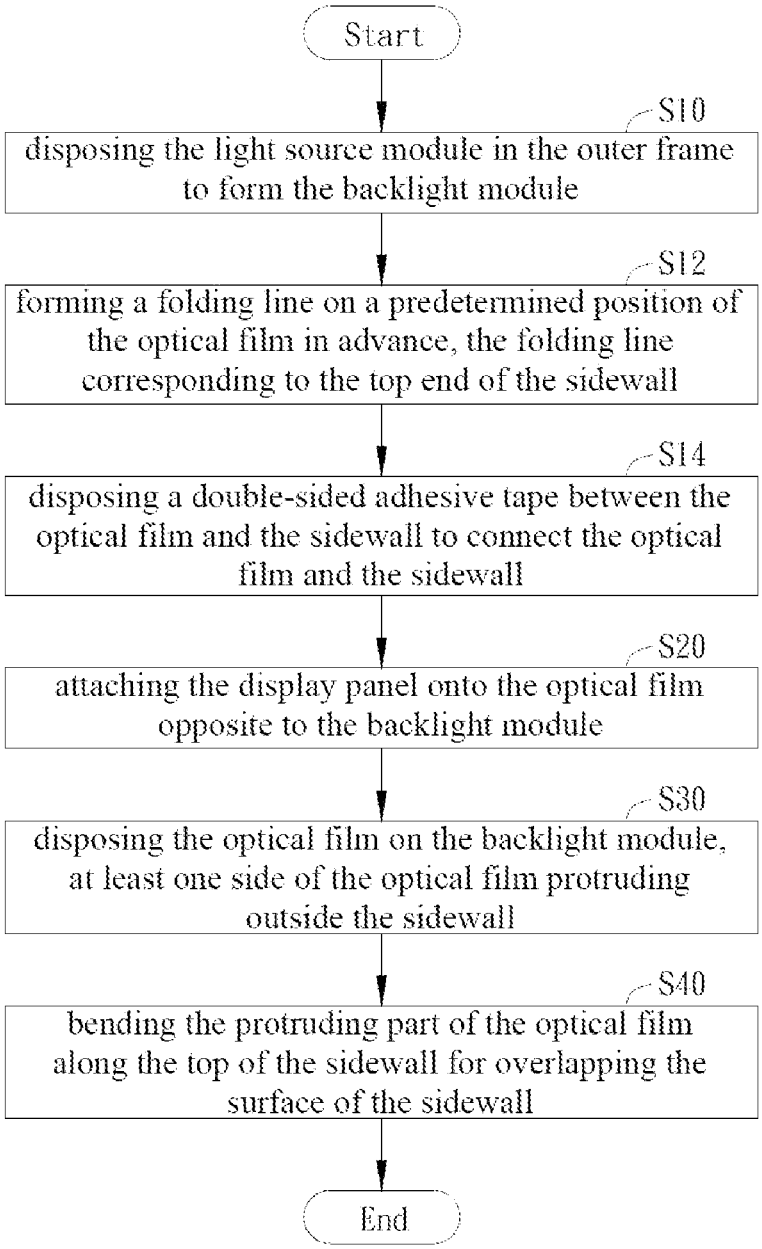
FIG. 5 is a detailed flow chart of assembling the display device of the present invention.

FIG. 5 is a detailed flow chart of assembling the display device of the present invention. In addition to the aforementioned steps, the assembling step further includes: step S12 of forming a folding line on a predetermined position of the optical film in advance, the folding line corresponding to the top end of the sidewall. The folding line is formed as indentation or spaced slits. The assembling efficiency may be promoted by forming the folding line in advance. Besides, the folding line may be utilized for position alignment to promote convenience of assembling. Step S14 involves disposing a double-sided adhesive tape between the optical film and the sidewall to connect the optical film and the sidewall. After the edge of the display panel is aligned to the optical film, the optical film is bent to partially overlap the surface of the sidewall. The double-sided adhesive tape connects the optical film and the surface of the sidewall. The outer frame is connected to the bending part and the non-bending part of the optical film by the double-sided adhesive tape. The double-sided adhesive tape at the non-bending part of the optical film shields a part of the edge of the backlight module to achieve a better light shielding effect. In order to avoid decreasing the light emergent efficiency, it is preferred to maintain a space between the backlight module and a portion of the double-sided adhesive tape that shields the backlight module, i.e. to avoid the double-sided adhesive tape being directly attached to the backlight module. Besides, the double-sided adhesive tape may be pressed simultaneously while bending the optical film to enhance the adhesive force by pressing.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A display device, comprising:

a backlight module, comprising:

an outer frame having a bottom plate and a sidewall connected to one side of the bottom plate; and a light source module disposed in the outer frame and located on an inner side of the sidewall;

an optical film disposed above the backlight module and covering the light source module, wherein at least one side of the optical film protrudes outside the sidewall and is bent to at least partially overlap the sidewall; and a display panel disposed on the optical film opposite to the backlight module.

2. The display device of claim 1, wherein the optical film is attached to a light incident surface of the display panel.

3. The display device of claim 1, wherein the optical film comprises a polarization film.

4. The display device of claim 1, wherein a folding line is formed on the optical film and corresponds to the top end of the sidewall, the material strength at the folding line is weaker than that of the optical film at other positions.

5. The display device of claim 4, wherein the folding line is formed as indentation or spaced slits.

6. The display device of claim 1, further comprising a double-sided adhesive tape disposed between the optical film and the sidewall for attaching the optical film to the sidewall.

7. The display device of claim 6, wherein the double-sided adhesive tape is located between the top end of the sidewall and a non-bending part of the optical film.

8. The display device of claim 6, wherein the double-sided adhesive tape is located between a surface of the sidewall and a bending part of the optical film that overlaps the sidewall.

9. The display device of claim 6, wherein the double-sided adhesive tape is bent into two parts, one is located between the top end of the sidewall and a non-bending part of the optical film, and the other one is located between a surface of the sidewall and a bending part of the optical film that overlaps the sidewall.

10. The display device of claim 6, wherein the double-sided adhesive tape has a light shielding property.

11. The display device of claim 1, wherein the edge of the display panel extends over the top end of the sidewall and is indirectly supported by the top end of the sidewall through the optical film.

12. A manufacturing method of the display device of claim 1, comprising:

disposing the light source module in the outer frame to form the backlight module;

attaching the display panel onto the optical film opposite to the backlight module;

disposing the optical film on the backlight module, wherein at least one side of the optical film protrudes outside the sidewall as a protruding part; and bending the protruding part of the optical film along the top end of the sidewall to overlap a surface of the sidewall.

13. The manufacturing method of claim 12, further comprising a step of forming a folding line on a predetermined position of the optical film in advance, the folding line corresponding to the top end of the sidewall.

14. The manufacturing method of claim 12, wherein the step of disposing the optical film comprises: disposing a double-sided adhesive tape between the optical film and the sidewall to connect the optical film and the sidewall.

* * * * *